US009181684B2

(12) United States Patent
Okano et al.

(10) Patent No.: US 9,181,684 B2
(45) Date of Patent: Nov. 10, 2015

(54) PUMP CONTROL UNIT FOR HYDRAULIC SYSTEM

(75) Inventors: Yasuo Okano, Tsuchiura (JP); Tsuyoshi Nakamura, Tsuchiura (JP); Kouji Ishikawa, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 582 days.

(21) Appl. No.: 13/517,131

(22) PCT Filed: Feb. 2, 2011

(86) PCT No.: PCT/JP2011/052150

§ 371 (c)(1),
(2), (4) Date: Jun. 19, 2012

(87) PCT Pub. No.: WO2011/096435

PCT Pub. Date: Aug. 11, 2011

(65) Prior Publication Data

US 2012/0285157 A1 Nov. 15, 2012

(30) Foreign Application Priority Data

Feb. 3, 2010 (JP) ..... 2010-022516

(51) Int. Cl.
*F15B 15/18* (2006.01)
*E02F 9/22* (2006.01)

(52) U.S. Cl.
CPC ..... *E02F 9/2235* (2013.01); *E02F 9/2282* (2013.01); *E02F 9/2285* (2013.01); *E02F 9/2292* (2013.01); *E02F 9/2296* (2013.01); *F15B 2211/20553* (2013.01); *F15B 2211/20576* (2013.01); *F15B 2211/2654* (2013.01); *F15B2211/3116* (2013.01); *F15B 2211/6309* (2013.01); *F15B 2211/6313* (2013.01)

(58) Field of Classification Search
CPC ..... F15B 2211/20576; F15B 2211/2654; F15B 2211/6309; F15B 2211/6313; F15B 2211/3116; F15B 2211/20553; E02F 9/2292; E02F 9/2282; E02F 9/2285; E02F 9/2296; E02F 9/2235
USPC ..... 60/431
See application file for complete search history.

(56) References Cited

U.S. PATENT DOCUMENTS 8,162,618 B2 * 4/2012 Nakamura et al. ..... 417/34

FOREIGN PATENT DOCUMENTS

| | | | |
|---|---|---|---|
| JP | 05-302575 A | | 11/1993 |
| JP | 2000-073960 A | | 3/2000 |
| JP | 2001-248186 A | | 9/2001 |
| JP | 3576064 B2 | | 7/2004 |
| JP | 2012202220 A | * | 10/2012 |

* cited by examiner

*Primary Examiner* — Dwayne J White
*Assistant Examiner* — Logan Kraft
(74) *Attorney, Agent, or Firm* — Mattingly & Malur, PC

(57) ABSTRACT

During a swing start, a pump torque calculating section associated with pump delivery pressure, a pump torque calculating section associated with swing operation pressure, and a maximum value selecting section of a controller perform control to change a maximum absorption torque of a second hydraulic pump between Tb and Tc in accordance with a delivery pressure of the second hydraulic pump. In an operation combining swing with other motion, a subtraction section performs a calculation to subtract a maximum absorption torque Tp2 of the second hydraulic pump from a total pump torque Tr0 to thereby distribute an amount of torque reduced in the second hydraulic pump to a first hydraulic pump associated with an actuator other than a swing motor. Further, a required flow rate can be supplied to the swing motor, thus achieving a smooth shift to a constant speed swing.

2 Claims, 6 Drawing Sheets

PUMP CONTROL UNIT FOR HYDRAULIC SYSTEM

TECHNICAL FIELD

The present invention relates to pump control units for hydraulic systems provided for construction machines such as hydraulic excavators. More specifically, the present invention relates to, in a hydraulic drive system for a construction machine including an upper swing structure, a pump control unit for controlling torque distribution among a plurality of hydraulic pumps according to a working condition.

BACKGROUND ART

A hydraulic excavator is known as a typical construction machine including an upper swing structure. A hydraulic system for such a hydraulic excavator very often uses a pump control unit that incorporates a regulator for controlling a displacement volume of a hydraulic pump to which a torque control function is added. The pump control unit incorporating a regulator to which the torque control function is added guides a delivery pressure of the hydraulic pump to the regulator. When the delivery pressure builds up so that an absorption torque of the hydraulic pump reaches a set maximum absorption torque, the pump control unit controls to reduce the displacement volume of the hydraulic pump for any further increase in the delivery pressure of the hydraulic pump, thereby controls to keep the absorption torque of the hydraulic pump within the set maximum absorption torque. This prevents engine stall due to overload of a prime mover.

If there are two or more hydraulic pumps involved, a pump control unit that performs torque control called total horsepower control is generally employed. The total horsepower control works as follows. For example, as disclosed in patent document 1, a delivery pressure of each of two hydraulic pumps (hereinafter referred to as first and second hydraulic pumps) is guided to a regulator of each of the two hydraulic pumps. When a sum of an absorption torque of the first hydraulic pump and an absorption torque of the second hydraulic pump reaches a set maximum absorption torque, the total horsepower control works to reduce the displacement volume of each of the first and second hydraulic pumps for any further increase in the delivery pressure of the hydraulic pump. This allows total horsepower assigned to the first and second hydraulic pumps to be used, when an actuator involved in each of the first and second hydraulic pumps is independently driven, so that an effective use of a prime mover output can be achieved.

Patent document 2 discloses a pump control unit incorporating two or more hydraulic pumps. When it is determined, based on electrical signals from a plurality of control levers, that work requires two of a plurality of actuators to be operated simultaneously, distribution ratios of an engine output to be distributed to the hydraulic pumps connected to each of the two actuators are set, according to a combination of the two actuators. A tilting angle of each of the hydraulic pumps is controlled to achieve the distribution ratios.

PRIOR ART DOCUMENTS

Patent Document

Patent Document 1

JP, A2000-73960

Patent Document 2

Japanese Patent No. 3576064

SUMMARY OF THE INVENTION

Problem to be Solved by the Invention

In a construction machine including an upper swing structure, such as the hydraulic excavator, during a start of a swing of the upper swing structure from a stationary state (including acceleration following the swing start; the same holds true hereunder), the upper swing structure places a heavy inertia load on a swing motor (which is an actuator). As a result, the delivery pressure of the hydraulic pump rises sharply to reach a maximum pressure (relief pressure) determined by a relief valve and an energy loss is produced by a hydraulic fluid escaping from the relief valve. If a delivery flow rate of the hydraulic pump is excessively high at this time, the energy loss increases to thereby reduce energy efficiency. As the upper swing structure accelerates to increase a swing speed, the relief from the relief valve stops and the supply of a required flow rate from the hydraulic pump to the swing motor becomes short, resulting in a decrease in the delivery pressure of the hydraulic pump. If the delivery flow rate of the hydraulic pump is excessively low at this time, the swing motor is unable to smoothly achieve a constant speed for swing due to insufficient flow rate, and the work efficiency is lowered.

In the pump control units disclosed in patent documents 1 and 2, during a swing start in an independent swing operation, torque control is conducted in such a manner as to consume total horsepower (total torque) in one hydraulic pump associated with the swing motor. A reduction in the displacement volume of the hydraulic pump decreases and the delivery flow rate of the hydraulic pump becomes higher than required. As a result, relatively large amount of hydraulic fluid escape from the relief valve. This causes a large energy loss and lowering of energy efficiency, and also tends to damage hydraulic equipment by heat.

The hydraulic excavator and other construction machines include a plurality of hydraulic cylinders and hydraulic motors in addition to the swing motor, and perform a combined swing operation in which the swing motor and other actuators are simultaneously driven.

In the pump control unit disclosed in patent document 1, the two hydraulic pumps are controlled in association with each other so that their displacement volumes become same by the total horsepower control. Therefore, during a swing start in the combined swing operation, the delivery flow rate of the hydraulic pump associated with the swing motor becomes large and an energy loss due to relief may occur. Such facts may cause the same problem as that occurs during the swing start in the independent swing operation. Further, depending on the type of work performed by the combined swing operation, a hydraulic pump associated with an actuator other than the swing motor may be desired to have larger delivery flow rate. For example, in a swing and boom raising work such as conveying soil onto a truck or dump truck vessel after soil evacuation, it is desirable that the boom raises quickly during the swing start, and the upper swing structure revolves quickly afterwards. If these requirements are met, the work operability of combined operation and work efficiency can be improved. When the pump control unit disclosed in patent document 1 performs such swing and boom raising operations, the amount of the boom raising during the swing start, or the swing speed in the following time may be insufficient due to the reduction in the flow rate for the total horsepower control. As a result, combined work operability and work efficiency may be lowered.

In the pump control unit disclosed in patent document 2, the distribution ratios of the engine output for the hydraulic pumps are constant. If the distribution ratios are set so that the delivery flow rate of the hydraulic pump associated with an actuator other than the swing motor is large during the swing start, the delivery flow rate of the hydraulic pump associated with the swing motor becomes small. Therefore, in the process of transiting to a constant speed following the swing start, a required flow rate cannot be supplied to the swing motor, so that a constant speed swing cannot be smoothly achieved.

A first object of the present invention is to provide a pump control unit for a hydraulic system, capable of improving energy efficiency by reducing an energy loss due to relief during a swing start, and improving work efficiency by supplying a required flow rate to a swing motor during a process of transiting to a constant speed following the swing start to thereby smoothly achieve a constant speed swing.

A second object of the present invention is to provide a pump control unit for a hydraulic system, capable of improving energy efficiency by reducing an energy loss due to relief during a swing start and, in a combined swing operation, improving combined work operability and work efficiency by increasing a speed of an actuator other than a swing motor during a swing start and supplying the swing motor with a required flow rate during a process of transiting to a constant speed following the swing start to thereby smoothly achieve a constant speed swing.

Means for Solving the Problem (1) In order to achieve the first object, the present invention provides a pump control unit for a hydraulic system. The hydraulic system includes: first and second hydraulic pumps driven by a prime mover, the first and second hydraulic pumps being variable displacement type; a plurality of actuators driven by a hydraulic fluid delivered from the first hydraulic pump, the actuators including a boom cylinder for driving a boom of a hydraulic excavator; a plurality of actuators driven by a hydraulic fluid delivered from the second hydraulic pump, the actuators including a swing motor for driving an upper swing structure of the hydraulic excavator; a plurality of operating means including first and second operating means for operating the boom cylinder and the swing motor, respectively; and a relief valve for determining maximum pressures of the hydraulic fluids delivered from the first and second hydraulic pumps. The pump control unit includes: pressure detecting means for detecting a delivery pressure of the second hydraulic pump; first pump torque control means for setting maximum absorption torque of the first hydraulic pump and controlling a displacement volume of the first hydraulic pump so that an absorption torque of the first hydraulic pump does not exceed the maximum absorption torque; and second pump torque control means for setting maximum absorption torque of the second hydraulic pump and controlling a displacement volume of the second hydraulic pump so that an absorption torque of the second hydraulic pump does not exceed the maximum absorption torque. The second pump torque control means has a preset maximum torque value consumable and a preset torque value smaller than the maximum torque value. When the delivery pressure of the second hydraulic pump, detected by the pressure detecting means, is lower than a predetermined pressure that is below the maximum pressure determined by the relief valve, the second pump torque control means sets the maximum torque value as the maximum absorption torque of the second hydraulic pump, and when the delivery pressure of the second hydraulic pump, detected by the pressure detecting means, increases to reach the maximum pressure determined by the relief valve, the torque value smaller than the maximum torque value of is set as the maximum absorption torque of the second hydraulic pump.

In the present invention having arrangements as described above, during a swing start (including acceleration immediately following the swing start; the same holds true hereunder), when the delivery pressure of the second hydraulic pump rises sharply and reaches the maximum pressure determined by the relief valve, the second pump torque control means sets the torque value smaller than the maximum torque value as the maximum absorption torque of the second hydraulic pump. The maximum absorption torque of the second hydraulic pump is thereby controlled to be reduced, and the displacement volume of the second hydraulic pump decreases. Consequently, the delivery flow rate of the second hydraulic pump decreases and the relief flow rate from the relief valve thereby decreases. Energy loss during the swing start can be reduced to improve energy efficiency.

Thereafter, as the upper swing structure accelerates and the swing speed is increased, relief from the relief valve stops and the second hydraulic pump becomes incapable of supplying a required flow rate for the swing motor. The delivery pressure of the second hydraulic pump therefore decreases. At this point, the second pump torque control means set the maximum torque value as the maximum absorption torque of the second hydraulic pump, to thereby perform a control to increase the absorption torque of the second hydraulic pump in accordance with the decrease in the delivery pressure of the second hydraulic pump (a control that varies the maximum absorption torque of the second hydraulic pump according to the delivery pressure of the second hydraulic pump). The displacement volume of the second hydraulic pump thus gradually increases. As a result, the delivery flow rate of the second hydraulic pump increases with the rise in swing speed to allow a required flow rate to be supplied to the swing motor. A smooth shift to a constant speed swing and an improvement of work efficiency can be achieved.

(2) In order to achieve the second object, in (1) described above, the first pump torque control means set, as the maximum absorption torque of the first hydraulic pump, the difference of the total pump torque consumable by the first and second hydraulic pumps and the maximum absorption torque of the second hydraulic pump set for the second pump torque control means.

In the present invention having arrangements as described above, during a swing start in a combined swing operation combining swing and motion other than swing, for example, a combined operation of swing and boom raising, the second pump torque control means sets the torque value smaller than the maximum torque value as the maximum absorption torque of the second hydraulic pump. The maximum absorption torque of the second hydraulic pump is thereby controlled to be reduced, and the displacement volume of the second hydraulic pump decreases, as described above. Simultaneously, the first pump torque control means sets, as the maximum absorption torque of the first hydraulic pump, the difference of the total pump torque consumable by the first and second hydraulic pumps and the maximum absorption torque of the second hydraulic pump set for the second pump torque control means. That is, the amount of torque reduced in the maximum absorption torque of the second hydraulic pump is added to the maximum absorption torque of the first hydraulic pump. The maximum absorption torque of the first hydraulic pump is controlled to be increased by changing the distribution between the maximum absorption torque of the first and second hydraulic pumps, and the displacement volume of the first hydraulic pump is thereby increased. As such, performing the control that distributes the amount of torque reduced in the second hydraulic pump to the first hydraulic pump that drives an actuator other than the swing motor (for example, the boom cylinder) (a control that distributes the amount of torque reduced in the torque reduction control of the second hydraulic pump associated with the swing motor to the first hydraulic pump associated with an actuator other than the swing motor) allows the speed of the actuator other than the swing motor to increase during the swing start in the combined swing operation. Consequently, improved combined work operability and work efficiency can be achieved.

Further, in the combined swing operation, as the upper swing structure accelerates to increase the swing speed and the relief from the relief valve stops, the second pump torque control means sets the maximum torque value as the maximum absorption torque of the second hydraulic pump. The absorption torque of the second hydraulic pump is controlled to increase according to the decrease of the delivery pressure of the second hydraulic pump. The displacement volume of the second hydraulic pump thus gradually increases. As a result, the delivery flow rate of the second hydraulic pump increases with the rise of swing speed and allows a required flow rate to be supplied to the swing motor. A smooth shift to a constant speed swing can therefore be achieved.

(3) In (1) or (2) described above, preferably, the pump control unit further includes operation amount detecting means for detecting an operation amount of the second operating means for operating the swing motor. When the operation amount of the second operating means detected by the operation amount detecting means exceeds a predetermined value, and the delivery pressure of the second hydraulic pump detected by the pressure detecting means increases to the maximum pressure determined by the relief valve, the second pump torque control means sets the torque value smaller than the maximum torque value as the maximum absorption torque of the second hydraulic pump. When the operation amount of the second operating means detected by the operation amount detecting means is equal to, or less than the predetermined value, regardless of the delivery pressure of the second hydraulic pump detected by the pressure detecting means, the second pump torque control means sets the maximum torque value as the maximum absorption torque of the second hydraulic pump.

During the swing operation, the operation amount of the second operating means exceeds the predetermined value. The second pump torque control means sets, according to the delivery pressure of the second hydraulic pump, the torque value smaller than the maximum torque value or the maximum torque value and performs control to change the maximum absorption torque of the second hydraulic pump, and thereby reduces energy loss due to relief during a swing start. Further, during a swing start in the combined swing operation, the second pump torque control means performs control to distribute the amount of torque reduced in the torque reducing control of the second hydraulic pump associated with the swing motor to the first hydraulic pump associated with an actuator other than the swing motor. The speed of the actuator other than the swing motor is thereby increased. During a process of transiting to a constant speed, following the swing start, the swing motor can be supplied a required flow rate to thereby smoothly achieve a constant speed swing.

On the other hand, during an operation in which, of the actuators associated with the second hydraulic pump, the actuator other than the swing motor is driven, the operation amount of the second operating means is equal to, or less than the predetermined value. The second pump torque control means sets, regardless of the delivery pressure of the second hydraulic pump detected by the pressure detecting means, the maximum torque value as the maximum absorption torque of the second hydraulic pump. As a result, the maximum absorption torque of the second hydraulic pump is maintained at a constant value regardless of changes in the delivery pressure of the second hydraulic pump. A change in the speed of the actuator due to a change in the maximum absorption torque of the second hydraulic pump can be prevented and operability and workability can thereby be avoided from being degraded.

Effects of the Invention

In the present invention, during the swing start, control is performed to vary the maximum absorption torque of the second hydraulic pump according to the delivery pressure of the second hydraulic pump. An energy loss due to relief during the swing start can therefore be reduced to improve energy efficiency. In addition, a required flow rate is supplied to the swing motor during acceleration following the swing start, thus achieving a smooth shift to a constant speed swing and improved work efficiency.

In the present invention, in the combined swing operation combining swing with other motion, control is performed to distribute an amount of torque reduced in the second hydraulic pump to the first hydraulic pump associated with an actuator other than the swing motor. The speed of the actuator other than the swing motor can therefore be increased and improvement of combined work operability and work efficiency can be achieved.

In addition, in the present invention, only when the second operating means for operating the swing motor is operated for an operation amount that is equal to or larger than a predetermined value, control is performed to vary the maximum absorption torque of the second hydraulic pump and to distribute the amount of torque reduced in the second hydraulic pump to the first hydraulic pump associated with the actuator other than the swing motor. Therefore, during operation for driving the actuator other than the swing motor, a change in the speed of the actuator due to a change in the maximum absorption torque of the second hydraulic pump can be prevented, and operability and workability can be avoided from being degraded.

MODES FOR CARRYING OUT THE INVENTION

An embodiment of the present invention will be described below with reference to the accompanying drawings.

<General Arrangements>

Figure 1:
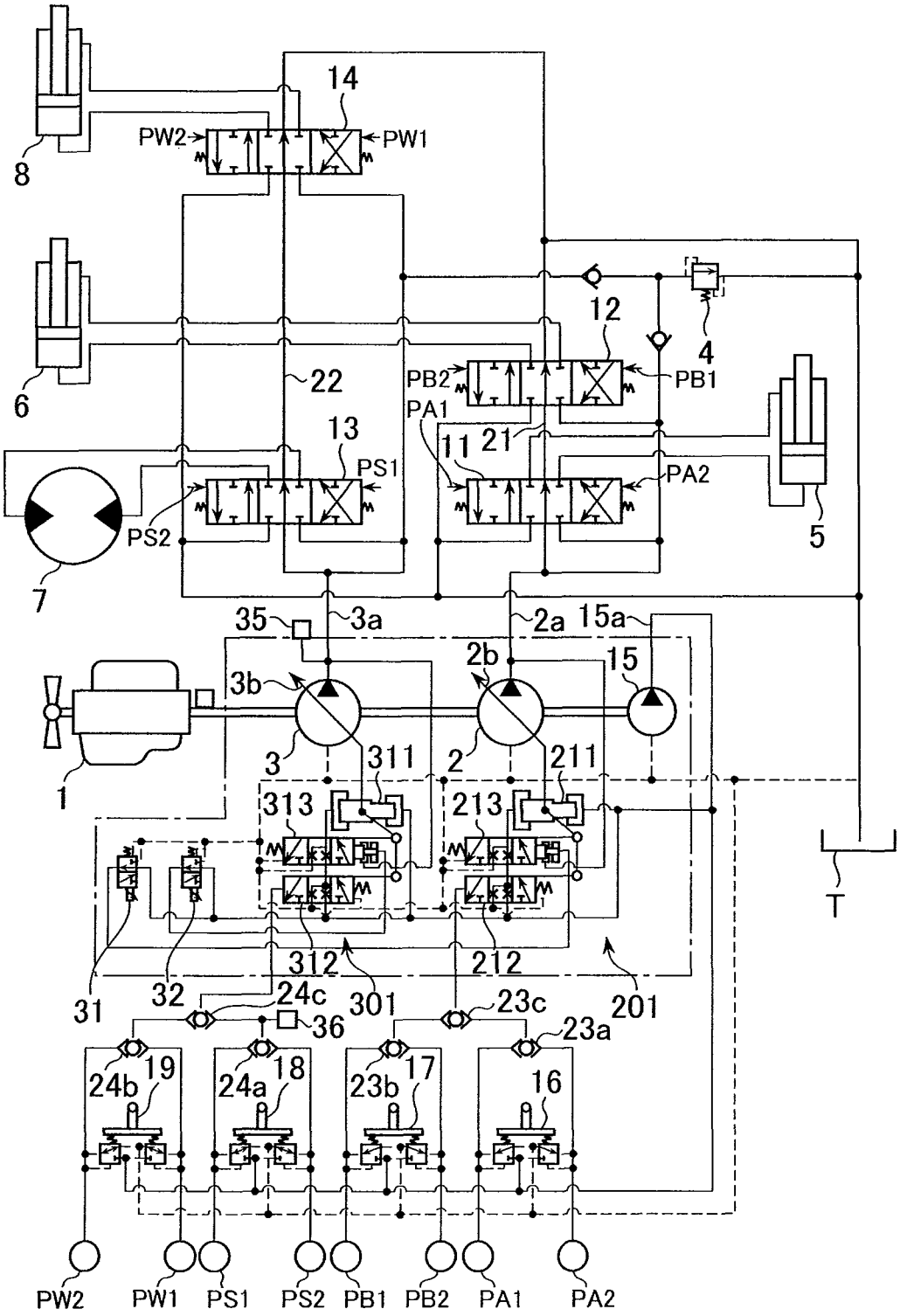
FIG. 1 is a hydraulic circuit diagram of a hydraulic system including a pump control unit according to an embodiment of the present invention.

FIG. 1 is a hydraulic circuit diagram of a hydraulic system including a pump control unit according to an embodiment of the present invention. The hydraulic system according to the embodiment of the present invention includes a prime mover such as a diesel engine (hereinafter simply referred to as engine) 1, a plurality of variable displacement hydraulic pumps which are driven by the engine 1, such as first and second hydraulic pumps 2, 3, a relief valve 4 which determines a maximum pressure of a hydraulic fluid delivered from the first and second hydraulic pumps 2, 3 (a maximum pressure of a hydraulic supply circuit), an arm cylinder 5 which is driven by hydraulic fluid delivered from the first and second hydraulic pumps 2, 3, a boom cylinder 6, a swing motor 7, a plurality of actuators including a bucket cylinder 8, a plurality of control valves including control valves 11 to 14 for controlling the flow rates and directions of the hydraulic fluid supplied from the first and second hydraulic pumps 2, 3 to the arm cylinder 5, the boom cylinder 6, the swing motor 7, and the bucket cylinder 8, a pilot pump 15 which is driven by the engine 1, and operation lever units 16 to 19 which generate control pilot pressure for operating the control valves 11 to 14 based on a delivery fluid from the pilot pump 15.

The control valves 11 to 14 are center bypass valves. The control valves 11, 12 are disposed in a center bypass line 21 and the control valves 13, 14 are disposed in a center bypass line 22. The center bypass line 21 has an upstream side connected to a delivery hydraulic line 2*a* of the first hydraulic pump 2 and a downstream side connected to a tank T. The center bypass line 22 has an upstream side connected to a delivery hydraulic line 3*a* of the second hydraulic pump 3 and a downstream side connected to the tank T. The control valves 11, 12 are intended for the arm and the boom, respectively, and connected in parallel to the delivery hydraulic line 2*a* of the first hydraulic pump 2, constitute a first hydraulic circuit with the arm cylinder 5 and the boom cylinder 6. The control valves 13, 14 are intended for swinging and the bucket, respectively, and connected in parallel to the delivery hydraulic line 3*a* of the second hydraulic pump 3, constitute a second hydraulic circuit with the swing motor 7 and the bucket cylinder 8.

The arm cylinder 5 serves as an actuator for pushing and pulling the arm of a hydraulic excavator. The boom cylinder 6 serves as an actuator for raising and lowering the boom. The swing motor 7 serves as an actuator for swinging an upper swing structure. The bucket cylinder 8 serves as an actuator for pushing and pulling the bucket.

The first hydraulic pump 2 includes a first regulator 201 and the second hydraulic pump 3 includes a second regulator 301. The first regulator 201 controls a pump delivery flow rate by adjusting a tilting angle (a displacement volume) of a swash plate 2*b*, which is a displacement varying member of the first hydraulic pump 2, according to a demanded flow rate (an operation amount of the operation lever unit 16, 17), and also controls the tilting angle of the first hydraulic pump 2 so that an absorption torque of the first hydraulic pump 2 does not exceed a set maximum absorption torque (described later). Similarly, the second regulator 301 controls the pump delivery flow rate by adjusting the tilting angle (the displacement volume) of a swash plate 3*b*, which is a displacement varying member of the second hydraulic pump 3, according to a demanded flow rate (an operation amount of the operation lever unit 18, 19), and also controls the tilting angle of the second hydraulic pump 3 so that the absorption torque of the second hydraulic pump 3 does not exceed a set maximum absorption torque (described later).

In the embodiment of the present invention, the first hydraulic pump 2 drives the arm cylinder 5 and the boom cylinder 6, and the second hydraulic pump 3 drives the swing motor 7 and the bucket cylinder 8. However, this is not the only possible arrangement. The first hydraulic pump may drive the bucket cylinder and the boom cylinder, and the second hydraulic pump may drive the swing motor and the arm cylinder.

Shuttle valves 23*a*, 23*b*, 23*c* are connected to a control pilot circuit that guides control pilot pressures generated by the operation lever units 16, 17 to the control valves 11, 12. The shuttle valves 23*a*, 23*b*, 23*c* select the highest pressure of the control pilot pressures generated by the operation lever units 16, 17. The highest pressure is applied to the first regulator 201 as a control signal pressure that determines the demanded flow rate of the first hydraulic pump 2.

Similarly, shuttle valves 24*a*, 24*b*, 24*c* are connected to a control pilot circuit that guides control pilot pressures generated by the operation lever units 18, 19 to the control valves 13, 14. The shuttle valves 24*a*, 24*b*, 24*c* select the highest pressure of the control pilot pressures generated by the operation lever units 18, 19. The highest pressure is applied to the second regulator 301 as a control signal pressure that determines the demanded flow rate of the second hydraulic pump 3.

<Pump Regulator>

Figure 2:
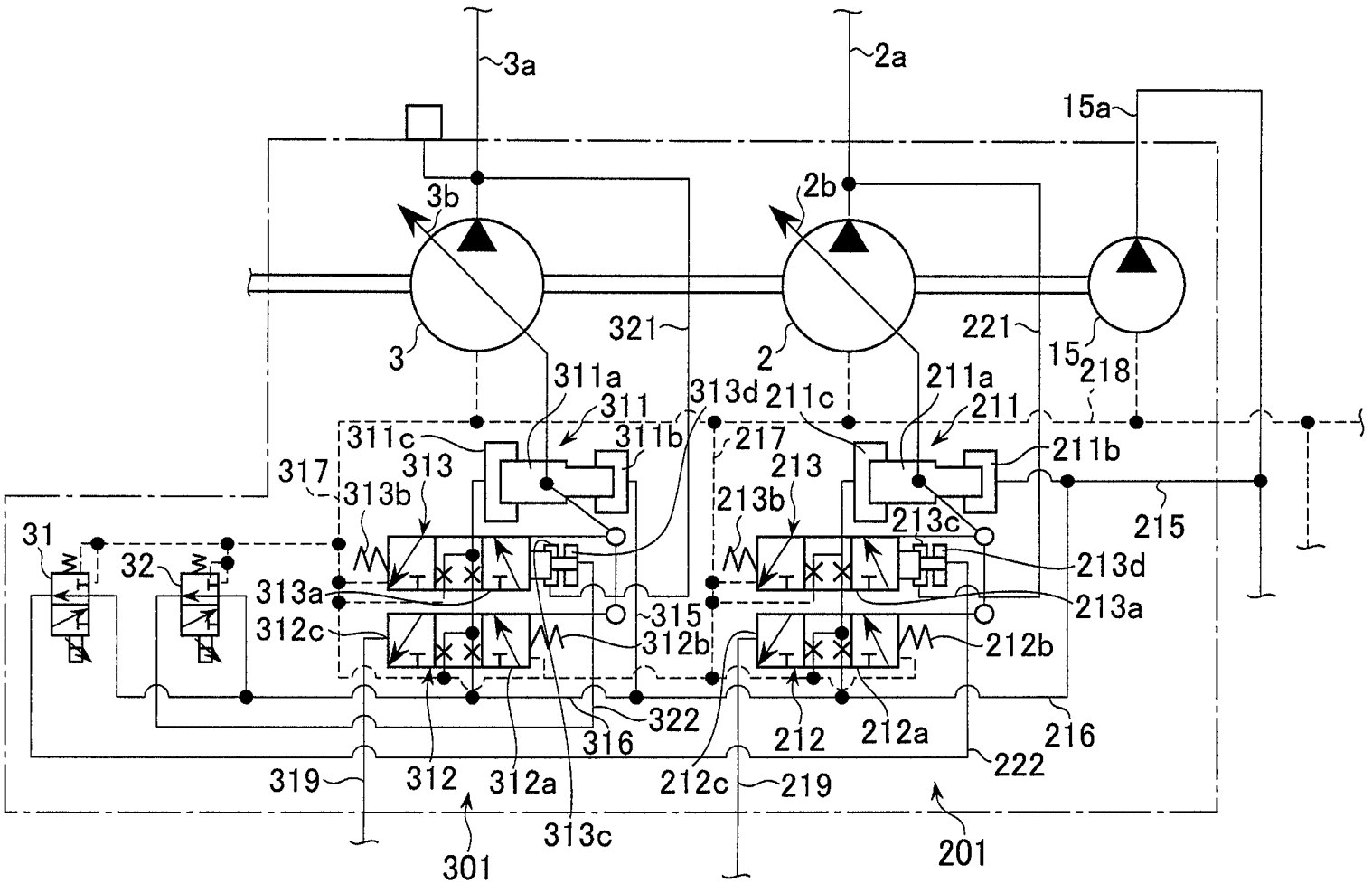
FIG. 2 is an enlarged hydraulic circuit diagram showing first and second regulator portions of the hydraulic system shown in FIG. 1.

FIG. 2 is an enlarged hydraulic circuit diagram showing the first and second regulators 201, 301 of the hydraulic system shown in FIG. 1.

The first regulator 201 includes a tilting control actuator 211, which tilts the swash plate 2*b* of the first hydraulic pump 2, and a pump flow rate control valve 212 and a pump torque control valve 213, which control the position of the tilting control actuator 211 (position of a control piston, described later). The control valves 212, 213 are formed as servo valves.

The tilting control actuator 211 includes a control piston 211*a* which is linked with the swash plate 2*b* and has pressure-receiving portions having different pressure-receiving areas on both ends, a pressure-receiving chamber 211*b* disposed on a side of the pressure-receiving portion with a smaller pressure-receiving area of the control piston 211*a*, and a pressure-receiving chamber 211*c* disposed on a side of the pressure-receiving portion with a larger pressure-receiving area of the control piston 211*a*. The control piston 211*a* is operated by a pressure balance between the pressure-receiving chambers 211*b* and 211*c* to thereby vary the tilting angle of the swash plate of the first hydraulic pump 2. The pressure-receiving chamber 211*b* is connected to a delivery line 15*a* of the pilot pump 15 via a hydraulic line 215. The pressure-receiving chamber 211*c* is connected to the delivery line 15*a* of the pilot pump 15 via the hydraulic line 215 and a hydraulic line 216, and the pump flow rate control valve 212 and the pump torque control valve 213. In addition, the pressure-receiving chamber 211*c* is connected to the tank T via the pump flow rate control valve 212 and the pump torque control valve 213, and hydraulic lines 217 and 218.

The pump flow rate control valve 212 includes a flow rate control spool 212*a*, a weak spring 212*b* for holding position disposed on a first end side of the flow rate control spool 212*a*, and a pressure-receiving chamber 212*c* disposed on a second end side of the flow rate control spool 212*a*. The highest pressure of the control pilot pressures of the operation lever units 16, 17 selected with the shuttle valves 23*a*, 23*b*, 23*c* is guided as a control signal pressure for the first hydraulic pump 2 to the pressure-receiving chamber 212*c* via a hydraulic line 219.

The pump torque control valve 213 includes a torque control spool 213*a*, a spring 213*b* disposed on a first end side of the torque control spool 213*a*, a PQ control pressure-receiving chamber 213*c*, and a torque reducing control pressure-receiving chamber 213*d*. The PQ control pressure-receiving chamber 213*c* and the torque reducing control pressure-receiving chamber 213*d* are disposed on a second end side of the torque control spool 213*a*. The PQ control pressure-receiving chamber 213*c* is connected to the delivery hydraulic line 2*a* of the first hydraulic pump 2 via a hydraulic line 221, and the delivery pressure of the first hydraulic pump 2 is guided therethrough. The torque reducing control pressure-receiving chamber 213*d* is connected to an output port of a first solenoid proportional valve 31 via a hydraulic line 222, and a control pressure output from the first solenoid proportional valve 31 is guided therethrough. The spring 213*b* and the torque reducing control pressure-receiving chamber 213*d* are disposed on opposite sides. An urging force given by the spring 213*b*, which acts rightward in the figure, is set to be greater than an urging force generated by the torque reducing control pressure-receiving chamber 213*d*, which acts leftward in the figure. The difference between the urging force of the spring 213*b* and the urging force of the torque reducing control pressure-receiving chamber 213*d*, which is a rightward urging force, is used to determine the maximum absorption torque of the first hydraulic pump 2. This maximum absorption torque is adjusted by the control pressure guided to the torque reducing control pressure-receiving chamber 213*d* from the first solenoid proportional valve 31.

When the control signal pressure (demanded flow rate) guided to the pressure-receiving chamber 212*c* increases, the pump flow rate control valve 212 displaces the flow rate control spool 212*a* to the right side in the figure. The pressure-receiving chamber 211*c* disposed on the larger-area-side of the tilting control actuator 211 is thereby brought into communication with the tank T, and the pressure in the pressure-receiving chamber 211*c* is reduced. In reaction to the reduction in pressure in the pressure-receiving chamber 211*c*, the tilting control actuator 211 moves the control piston 211*a* to the left in the figure. A tilting amount (displacement volume) of the swash plate 2*b* of the first hydraulic pump 2 is thereby increased, and the delivery flow rate of the first hydraulic pump 2 is increased. In contrast, when the control signal pressure (demanded flow rate) decreases, the pump flow rate control valve 212 displaces the flow rate control spool 212*a* to the left in the figure, and the pressure-receiving chamber 211*c* on the larger-area-side of the tilting control actuator 211 is thereby brought into communication with the delivery line 15*a* of the pilot pump 15. Pressure in the pressure-receiving chamber 211*c* resultantly increased. According to this increase in pressure in the pressure-receiving chamber 211*c*, the tilting control actuator 211 moves the control piston 211*a* to the right side in the figure. The tilting amount (displacement volume) of the swash plate 2*b* of the first hydraulic pump 2 is thereby decreased, and the delivery flow rate of the first hydraulic pump 2 is decreased.

As described above, the pump flow rate control valve 212 varies the pressure of the pressure-receiving chamber 211*c* disposed on the larger-area-side of the tilting control actuator 211, according to the control signal pressure (demanded flow rate) guided to the pressure-receiving chamber 212*c*. The tilting angle of the swash plate 2*b* of the first hydraulic pump 2 is thereby adjusted to control the pump delivery flow rate.

When the delivery pressure of the first hydraulic pump 2 guided to the PQ control pressure-receiving chamber 213*c* increases, the urging force generated in the PQ control pressure-receiving chamber 213*c*, which acts leftward in the figure, may exceed the urging force caused by the difference between the urging force of the spring 213*b* and the urging force of the torque reducing control pressure-receiving chamber 213*d*, which acts rightward in the figure. The pump torque control valve 213 accordingly displaces the torque control spool 213*a* to the left in the figure, and brings the pressure-receiving chamber 211*c* disposed on the larger-area-side of the tilting control actuator 211 into communication with the delivery line 15*a* of the pilot pump 15. Pressure in the pressure-receiving chamber 211*c* is thereby increased. In reaction to this increase in pressure in the pressure-receiving chamber 211*c*, the tilting control actuator 211 moves the control piston 211*a* to the right in the figure, and decreases the tilting amount (displacement volume) of the swash plate 2*b* of the first hydraulic pump 2. The delivery flow rate of the first hydraulic pump 2 is thereby decreased. In contrast, when the delivery pressure of the first hydraulic pump 2 decreases, and the urging force generated in the PQ control pressure-receiving chamber 213*c*, which acts leftward in the figure, becomes lower than the urging force caused by the difference between the urging force of the spring 213*b* and the urging force of the torque reducing control pressure-receiving chamber 213*d*, which acts rightward in the figure, the pump torque control valve 213 displaces the torque control spool 213*a* to the right in the figure. The pressure-receiving chamber 211*c* disposed on the larger-area-side of the tilting control actuator 211 is thereby brought into communication with the tank T. The pressure in the pressure-receiving chamber 211*c* is thus decreased. Due to this decrease in pressure in the pressure-receiving chamber 211*c*, the tilting control actuator 211 moves the control piston 211*a* to the left in the figure, and increases the tilting amount (displacement volume) of the swash plate 2*b* of the first hydraulic pump 2. Consequently, the delivery flow rate of the first hydraulic pump 2 is increased.

When the pump torque control valve 213 operates and controls the displacement volume of the first hydraulic pump 2, the delivery pressure of the first hydraulic pump 2 increases and the absorption torque of the first hydraulic pump 2 increases. In accordance to this, the pump torque control valve 213 controls so that the absorption torque of the first hydraulic pump 2 does not exceed the maximum absorption torque, which is set by the urging force caused by the difference between the urging force of the spring 213*b* and the urging force of the torque reducing control pressure-receiving chamber 213*d*, which acts rightward in the figure. In addition, the maximum absorption torque is adjusted by the control pressure guided into the torque reducing control pressure-receiving chamber 213*d* from the first solenoid proportional valve 31.

The second regulator 301 includes a tilting control actuator 311 which tilts the swash plate 3*b* of the second hydraulic pump 3, and a pump flow rate control valve 312 and a pump torque control valve 313, which control the drive of the actuator 311. The control valves 312, 313 are formed as servo valves.

The tilting control actuator 311, the pump flow rate control valve 312 and the pump torque control valve 313 are arranged in the same manner as the tilting control actuator 211, the pump flow rate control valve 212 and the pump torque control valve 213, respectively, of the first regulator 201. In the figure, the reference numerals of the corresponding parts of the second regulator 301 are shifted from the first regulator 201, shifted from 200 series to 300 series.

A pressure-receiving chamber 311*b* of the tilting control actuator 311 is connected to the delivery line 15*a* of the pilot pump 15 via a hydraulic line 315 and the hydraulic lines 215, 216. A pressure-receiving chamber 311*c* is connected to the delivery line 15*a* of the pilot pump 15 via the pump flow rate control valve 312 and the pump torque control valve 313, and a hydraulic line 316 and the hydraulic lines 215, 216. Further, the pressure-receiving chamber 311*c* is connected to the tank T via the pump flow rate control valve 312 and the pump torque control valve 313, and a hydraulic line 317 and the hydraulic line 218. The highest pressure of the control pilot pressures of the operation lever units 18, 19, selected with the shuttle valves 24*a*, 24*b*, 24*c* is guided to a pressure-receiving chamber 312*c* of the pump flow rate control valve 312 via a hydraulic line 319 as a control signal pressure of the second hydraulic pump 3. A PQ control pressure-receiving chamber 313*c* of the pump torque control valve 313 is connected to the delivery hydraulic line 3*a* of the second hydraulic pump 3 via a hydraulic line 321, and the delivery pressure of the second hydraulic pump 3 is guided therethrough. A torque reducing control pressure-receiving chamber 313*d* is connected to an output port of a second solenoid proportional valve 32 via a hydraulic line 322, and a control pressure output from a second solenoid proportional valve 32 is guided therethrough.

Similarly to the pump flow rate control valve 212 of the first regulator 201, the pump flow rate control valve 312 varies the pressure in the pressure-receiving chamber 311*c* disposed on a larger-area-side of the tilting control actuator 311 according to a control signal pressure (demanded flow rate) guided to the pressure-receiving chamber 312*c*. The tilting angle of the swash plate 3*b* of the second hydraulic pump 3 is thereby adjusted to control the pump delivery flow rate.

Similarly to the pump torque control valve 213 of the first regulator 201, the pump torque control valve 313 sets the maximum absorption torque of the second hydraulic pump 3 using the urging force caused by the difference between the urging force of a spring 313*b* and the urging force of the torque reducing control pressure-receiving chamber 313*d*, which acts rightward in the figure. In addition, when the delivery pressure of the second hydraulic pump 3 rises and the absorption torque of the second hydraulic pump 3 increases, the pump torque control valve 313 controls so that the absorption torque of the second hydraulic pump 3 does not exceed the maximum absorption torque set by the urging force caused by the difference between the urging force of the spring 313*b* and the urging force of the torque reducing control pressure-receiving chamber 313*d*, which acts rightward in the figure. The maximum absorption torque is adjusted by the control pressure guided into the torque reducing control pressure-receiving chamber 313*d* from the second solenoid proportional valve 32.

<Pump Control Unit>

Figure 3:
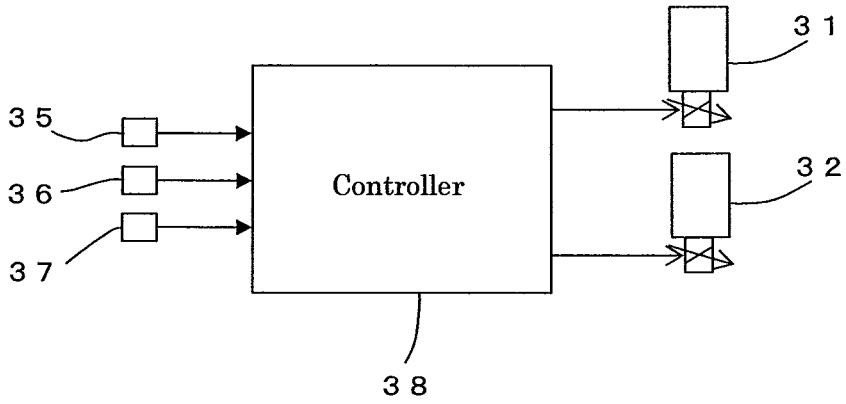
FIG. 3 is a diagram showing a general configuration of the pump control unit according to the embodiment of the present invention.

FIG. 3 is a diagram showing a general configuration of the pump control unit according to the embodiment of the present invention, disposed in the hydraulic system as described heretofore. The pump control unit of this embodiment includes a pressure sensor 35 which is connected to the delivery hydraulic line 3*a* of the second hydraulic pump 3 and detects the delivery pressure of the second hydraulic pump 3, a pressure sensor 36 which is connected to an output side of the shuttle valve 24*a* and detects, as a swing operation pressure, a control pilot pressure generated by the operation lever unit 18, an engine speed command operating unit 37 including apparatuses such as engine control dial, a controller 38, and the above-described first and second solenoid proportional valves 31, 32 that are operated by a control current output from the controller 38.

The controller 38 inputs detection signals from the pressure sensors 35, 36, and a command signal from the engine speed command operating unit 37, performs a predetermined calculating process, and outputs a control current to the first and second solenoid proportional valves 31, 32. The pump torque control valves 213, 313 are thereby controlled, and thus the maximum absorption torque of the first and second hydraulic pumps 2, 3 are controlled.

<Controller>

Figure 4:
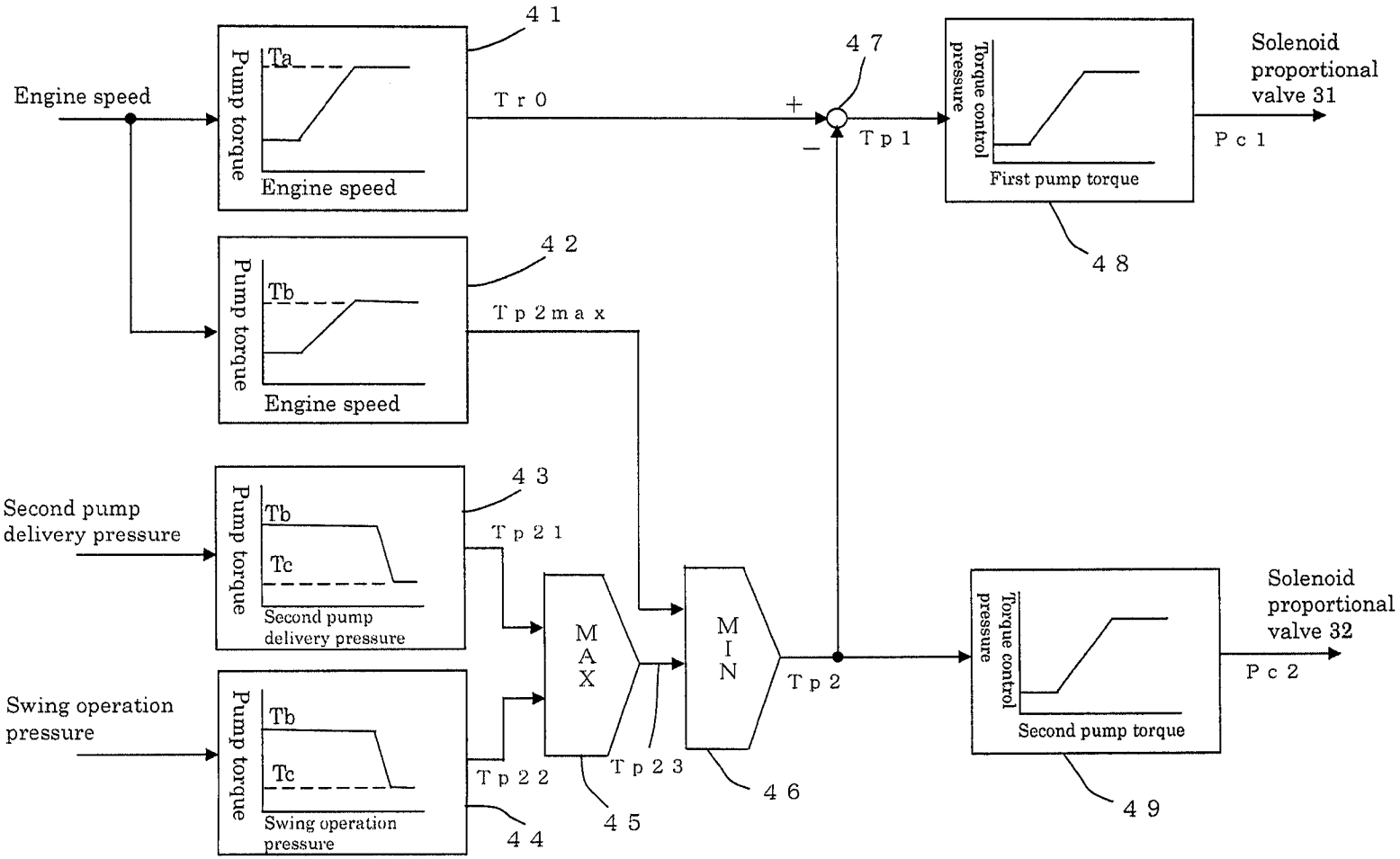
FIG. 4 is a functional block diagram showing details of processes performed by a controller.

FIG. 4 is a functional block diagram showing the processes performed by the controller 38. The controller 38 comprises calculation functions such as a total pump torque calculating section 41, a second pump allocating torque calculating section 42, a pump torque calculating section associated with pump delivery pressure 43, a pump torque calculating section associated with swing operation pressure 44, a maximum value selecting section 45, a minimum value selecting section 46, a subtraction section 47, a first torque control pressure calculating section 48, and a second torque control pressure calculating section 49.

The total pump torque calculating section 41 calculates a sum of pump torque (hereinafter referred to as total pump torque) Tr0, which is the pump torque consumable by the two pumps, namely, the first and second hydraulic pumps 2, 3, according to a target engine speed Nr of the engine 1 commanded by the engine speed command operating unit 37. This calculation is performed by inputting a command signal of the target engine speed Nr from the engine speed command operating unit 37, referring it to a table stored in a memory, and calculating the corresponding total pump torque Tr0. The total pump torque Tr0 is set so as to fall within the range of the output torque of the engine 1. In the table of the memory, a relationship between the target revolution speed Nr and the total pump torque Tr0 is set, so that, in response to changes in the output torque of the engine 1, when the target revolution speed Nr is close to the rated maximum revolution speed, the total pump torque Tr0 is a maximum value Ta, and as the target revolution speed Nr decreases, the total pump torque Tr0 is reduced.

The second pump allocating torque calculating section 42 calculates, according to the target engine speed Nr of the engine 1 commanded by the engine speed command operating unit 37, an allocated maximum pump torque Tp2max, which is the maximum limit of torque consumed by the second hydraulic pump 3. This calculation is performed by inputting a command signal of the target revolution speed Nr from the engine speed command operating unit 37, referring it to a table stored in a memory, and calculating the corresponding allocated maximum pump torque Tp2max. The allocated maximum pump torque Tp2max is a value determined by taking into consideration, within the range of the total pump torque Tr0, a maximum consumption pump torque for an independent operation or a combined operation of an actuator associated with the second hydraulic pump 3. For example, Tp2max=Tr0/2. The table of the memory sets a relationship between the target engine speed Nr and the allocated maximum pump torque Tp2max such that, in response to changes in the total pump torque Tr0, when the target engine speed Nr is close to a rated maximum engine speed, the allocated maximum pump torque Tp2max is, for example, a maximum value Tb, and when the target engine speed Nr decreases, the allocated maximum pump torque Tp2max is reduced. The maximum value Tb is, for example, half the maximum value Ta of the total pump torque Tr0(Tb=Ta/2).

The pump torque calculating section associated with pump delivery pressure 43 calculates first absorption torque Tp21 consumable by the second hydraulic pump 3 according to the delivery pressure of the second hydraulic pump 3 detected by the pressure sensor 35. This calculation is performed by inputting a detection signal of the delivery pressure of the second hydraulic pump 3 from the pressure sensor 35, referring it to a table stored in a memory, and thus calculating the first absorption torque Tp21 corresponding to the delivery pressure of the second hydraulic pump 3 indicated by the detection signal.

Figure 5:
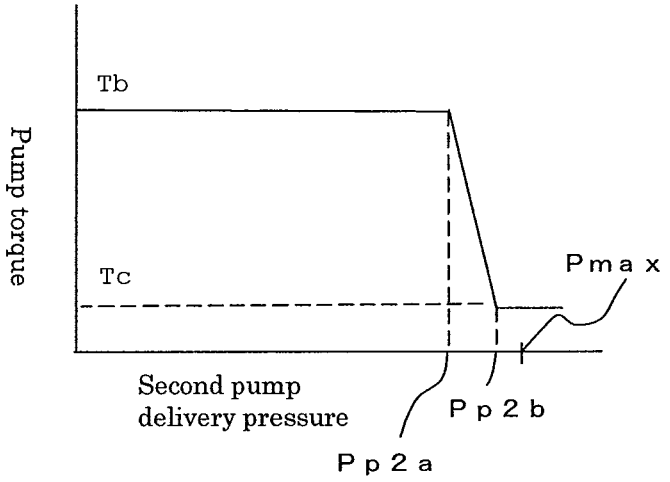
FIG. 5 is an enlarged diagram showing a relationship between a delivery pressure of a second hydraulic pump and first absorption torque of a pump torque calculating section associated with pump delivery pressure.

FIG. 5 is an enlarged diagram showing a relationship between the delivery pressure of the second hydraulic pump 3 and the first absorption torque Tp21 in the pump torque calculating section associated with pump delivery pressure 43. Referring to FIG. 5, the first absorption torque Tp21 is set to a value equal to, or less than the maximum value Tb of the allocated maximum pump torque Tp2max. The table in the memory sets a relationship between the delivery pressure of the second hydraulic pump 3 and the first absorption torque Tp21 so that, when the delivery pressure of the second hydraulic pump 3 is lower than a first pressure value Pp2*a* near a maximum pressure Pmax determined by the relief valve 4, the first absorption torque Tp21 becomes the value of maximum torque consumable in the second hydraulic pump 3, which is the value equal to the maximum value Tb of the allocated maximum pump torque Tp2max (Tp21=Tb), and when the delivery pressure of the second hydraulic pump 3 increases beyond the first pressure value Pp2*a*, the first absorption torque Tp21 decreases, and when the delivery pressure of the second hydraulic pump 3 further increases to exceed a second pressure value Pp2*b* (>Pp2*a*) near the maximum pressure Pmax determined by the relief valve 4, the first absorption torque Tp21 decreases to a torque value Tc that is smaller than the maximum value Tb (Tp21=Tc). The torque value Tc is pre-calculated and preset as a minimum torque value required for the swing start.

In the example shown in the figure, in order to avoid a drastic change in the first absorption torque Tp21, the first absorption torque Tp21 is varied between Tb and Tc by setting the first pressure value Pp2*a* and the second pressure value Pp2*b* as threshold values. However, for example, the first absorption torque Tp21 may be varied between Tb and Tc by setting the second pressure value Pp2*b* as the threshold value. In addition, although the second pressure value Pp2*b* is defined, in the above-description, as a value near the maximum pressure Pmax determined by the relief valve 4, it may be the very maximum pressure Pmax.

The pump torque calculating section associated with swing operation pressure 44 calculates second absorption torque Tp22 consumable by the second hydraulic pump 3 according to the swing operation pressure detected by the pressure sensor 36. This calculation is performed by inputting a detection signal of the swing operation pressure from the pressure sensor 36, referring it to a table stored in a memory, and thus calculating the second absorption torque Tp22 corresponding to the swing operation pressure indicated by the detection signal.

Figure 6:
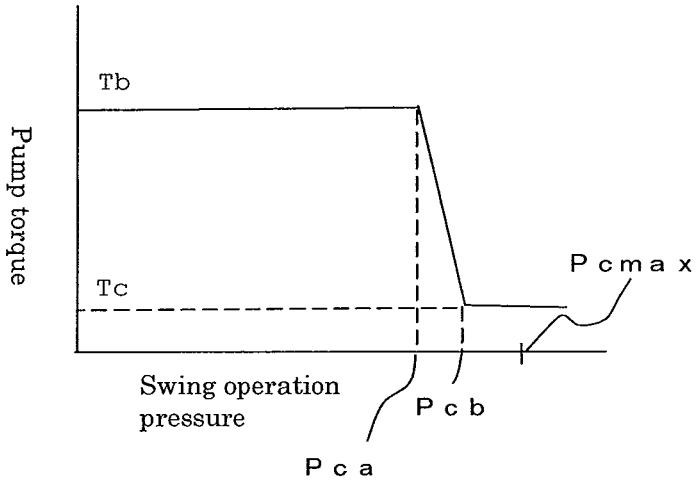
FIG. 6 is an enlarged diagram showing a relationship between a swing operation pressure and second absorption torque of a pump torque calculating section associated with swing operation pressure.

FIG. 6 is an enlarged diagram showing a relationship between the swing operation pressure and the second absorption torque Tp22 in the pump torque calculating section associated with swing operation pressure 44. Referring to FIG. 6, the second absorption torque Tp22 is also set to a value equal to, or less than the maximum value Tb of the allocated maximum pump torque Tp2max. The table of the memory sets a relationship between the swing operation pressure and the second absorption torque Tp22 so that, when the swing operation pressure (control pilot pressure for swing) is lower than a pressure value Pca near a maximum pressure Pcmax, the second absorption torque Tp22 becomes equal to the maximum value Tb of the allocated maximum pump torque Tp2max (Tp22=Tb), and when the swing operation pressure increases beyond the pressure value Pca, the second absorption torque Tp22 decreases, and when the swing operation pressure further increases to exceed a pressure value Pcb (>Pca) near the maximum pressure Pcmax, the second absorption torque Tp22 decreases to a torque value Tc, which is equal to the torque value set in the pump torque calculating section associated with pump delivery pressure 43 when the delivery pressure of the second hydraulic pump 3 exceeds Pp2*b* (Tp22=Tc). The pressure value Pca is a value such that indicates that an operator has fully operated an operation lever of the operation lever unit 18 for swing with an intention to perform a swing start. The value may be, for example, a value of 80% or more of a maximum swing operation pressure.

The maximum value selecting section 45 selects the greater one of the first absorption torque Tp21 calculated by the pump torque calculating section associated with pump delivery pressure 43 and the second absorption torque Tp22 calculated by the pump torque calculating section associated with swing operation pressure 44. The selected greater torque is output as third absorption torque Tp23.

The minimum value selecting section 46 selects the smaller one of the allocated maximum pump torque Tp2max of the second hydraulic pump 3 calculated by the second pump allocating torque calculating section 42 and the third absorption torque Tp23 selected by the maximum value selecting section 45. The selected smaller torque is output as maximum absorption torque Tp2 for control of the second hydraulic pump 3.

The subtraction section 47 subtracts the maximum absorption torque Tp2 selected in the minimum value selecting section 46 from the total pump torque Tr0 calculated in the total pump torque calculating section 41, to thereby calculate maximum absorption torque Tp1 for control of the first hydraulic pump 2.

The first torque control pressure calculating section 48 calculates an output pressure (control pressure) of the first solenoid proportional valve 31, which is the pressure required in setting the maximum absorption torque Tp1 for control of the first hydraulic pump 2, calculated by the subtraction section 47, to the first regulator 201. The maximum absorption torque Tp1 is referred to a table stored in a memory to thereby calculate a control pressure Pc1 corresponding to the maximum absorption torque Tp1. The table in the memory sets a relationship between the maximum absorption torque Tp1 and the control pressure Pc1 so that the control pressure Pc1 decreases as the maximum absorption torque Tp1 increases, considering that the control pressure Pc1 from the first solenoid proportional valve 31 is input to the torque reducing control pressure-receiving chamber 213*d* disposed at an position opposite to the spring 213*b* (negative control). The control pressure Pc1 is output to the first solenoid proportional valve 31 after being converted and amplified to a control current of the first solenoid proportional valve 31 via a current conversion and amplification section (not shown). The current conversion and amplification section has a characteristic set by considering that the first solenoid proportional valve 31 is configured to, when the control current applied to a solenoid is a minimum, generate a maximum control pressure based on the delivery pressure of the pilot pump 15.

The second torque control pressure calculating section 49 calculates an output pressure (control pressure) of the second solenoid proportional valve 32, which is the pressure required in setting the second regulator 301 the maximum absorption torque Tp2 for control of the second hydraulic pump 3, selected by the minimum value selecting section 46. The maximum absorption torque Tp2 is referred to a table stored in a memory to thereby calculate a control pressure Pc2 corresponding to the maximum absorption torque Tp2. The table of the memory sets a relationship between the maximum absorption torque Tp2 and the control pressure Pc2 so that the control pressure Pc2 decreases as the maximum absorption torque Tp2 increases, considering that the control pressure Pc2 from the second solenoid proportional valve 32 is input to the torque reducing control pressure-receiving chamber 313*d* disposed at an position opposite to the spring 313*b* (negative control). The control pressure Pc2 is output to the second solenoid proportional valve 32 after being converted and amplified to a control current of the second solenoid proportional valve 32 via a current conversion and amplification section (not shown). The current conversion and amplification section has a characteristic set by considering that the second solenoid proportional valve 32 is configured to, when the control current applied to a solenoid is a minimum, generate a maximum control pressure based on the delivery pressure of the pilot pump 15.

In the foregoing arrangements, the pressure sensor 35 constitutes pressure detecting means that detects the delivery pressure of the second hydraulic pump 3. The engine speed command operating unit 37; the total pump torque calculating section 41, the subtraction section 47, and the first torque control pressure calculating section 48 of the controller 38; the first solenoid proportional valve 31; and the pump torque control valve 213 of the first regulator 201 together constitute first pump torque control means, which sets the maximum absorption torque Tp1 of the first hydraulic pump 2 and controls the displacement volume of the first hydraulic pump 2 so that the absorption torque of the first hydraulic pump 2 does not exceed the maximum absorption torque Tp1. The pump torque calculating section associated with pump delivery pressure 43, the pump torque calculating section associated with swing operation pressure 44, the maximum value selecting section 45, the minimum value selecting section 46, and the second torque control pressure calculating section 49 of the controller 38; the second solenoid proportional valve 32; and the pump torque control valve 313 of the second regulator 301 together constitute second pump torque control means, which sets the maximum absorption torque Tp2 of the second hydraulic pump 3 and controls the displacement volume of the second hydraulic pump 3 so that the absorption torque of the second hydraulic pump 3 does not exceed the maximum absorption torque Tp2. The second pump torque control means (the pump torque calculating section associated with pump delivery pressure 43, the second torque control pressure calculating section 49 of the controller 38; the second solenoid proportional valve 32; and the pump torque control valve 313 of the second regulator 301) has a preset maximum torque value Tb consumable by the second hydraulic pump 3 and a preset torque value Tc smaller than the maximum torque Tb. When the delivery pressure of the second hydraulic pump 3 detected by the pressure detecting means (pressure sensor 35) is lower than a predetermined pressure Pp2*a* that falls short of the maximum pressure Pmax determined by the relief valve 4, the maximum torque value Tb is set as the maximum absorption torque Tp2 of the second hydraulic pump 3. When the delivery pressure of the second hydraulic pump 3 detected by the pressure detecting means increases to reach the maximum pressure Pmax determined by the relief valve 4, the torque value Tc smaller than the maximum torque value Tb is set as the maximum absorption torque Tp2 of the second hydraulic pump 3.

In addition, the first pump torque control means (the subtraction section 47 of the controller 38) sets, as the maximum absorption torque Tp1 of the first hydraulic pump 2, the difference of the total pump torque Tr0 consumable by the first and second hydraulic pumps 2, 3 and the maximum absorption torque Tp2 of the second hydraulic pump 3 set for the second pump torque control means.

Further, the shuttle valve 24*a* and the pressure sensor 36 constitute operation amount detecting means that detects an operation amount of second operating means (operation lever unit 18) for operating the swing motor 7. The second pump torque control means (the pump torque calculating section associated with swing operation pressure 44 and the maximum value selecting section 45 of the controller 38) set the torque value Tc smaller than the maximum torque value Tb as the maximum absorption torque Tp2 of the second hydraulic pump 3 when the operation amount of the second operating means, detected by the operation amount detecting means, exceeds a range of predetermined values Pca to Pcb and the delivery pressure of the second hydraulic pump 3, detected by the pressure detecting means, increases to the maximum pressure Pmax determined by the relief valve 4. When the operation amount of the second operating means detected by the operation amount detecting means is equal to, or less than the range of predetermined values Pca to Pcb, regardless of the delivery pressure of the second hydraulic pump 3 detected by the pressure detecting means, the maximum torque value Tb is set as the maximum absorption torque Tp2 of the second hydraulic pump 3.

<Hydraulic Excavator>

Figure 7:
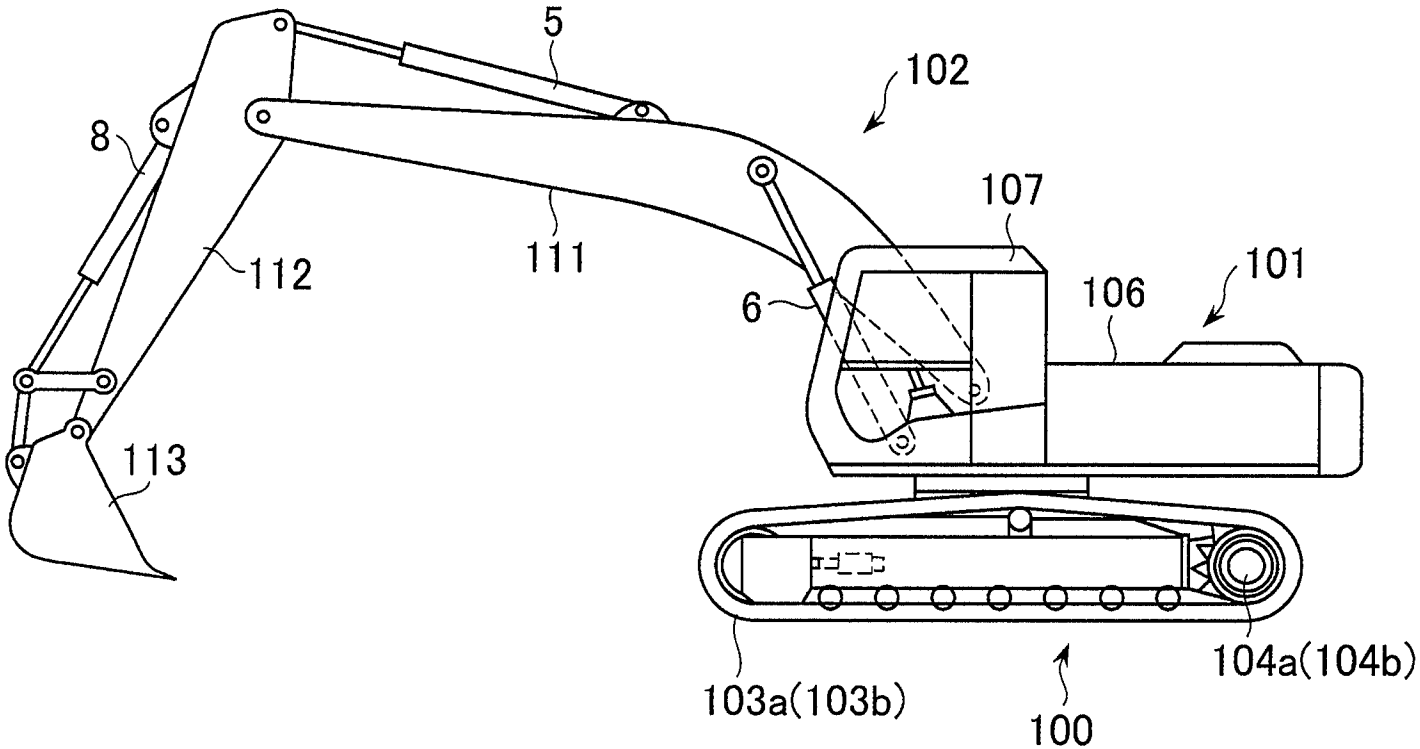
FIG. 7 is an illustration showing appearance of a hydraulic excavator.

FIG. 7 is an illustration showing appearance of the hydraulic excavator mounted with the hydraulic system shown in FIG. 1. The hydraulic excavator includes a lower track structure 100, an upper swing structure 101, and a front work implement 102. The lower track structure 100 includes left and right crawler type traveling mechanisms 103*a*, 103*b* driven by left and right traveling motors 104*a*, 104*b*, respectively. The upper swing structure 101 is swingably mounted on the lower track structure 100 and is driven by the swing motor 7. The front work implement 102 is disposed at a front portion of the upper swing structure 101 so as to be raised or lowered. The upper swing structure 101 includes an engine compartment 106 and a cabin (operator room) 107. The engine 1, the first and second hydraulic pumps 2, 3, the pilot pump 15, and other hydraulic devices are disposed in the engine compartment 106. The operation lever units 16 to 19, and the engine speed command operating unit 37 are disposed inside the cabin 107.

The front work implement 102 is a multi-jointed structure including a boom 111, an arm 112, and a bucket 113. The boom 111 is rotated vertically through extension and contraction of the boom cylinder 6, the arm 112 is rotated vertically, back and forth through extension and contraction of the arm cylinder 5, and the bucket 113 is rotated vertically, back and forth through extension and contraction of the bucket cylinder 8. FIG. 1 omits the actuators including the left and right traveling motors 104*a*, 104*b* and control systems thereof.

<Operation>

<Independent Swing Operation>

Operation during the independent swing operation will be first described.

When the control lever of the operation lever unit 18 for swing is fully operated to the left in FIG. 1, the swing operation pressure acts on a flow rate control spool 312*a* of the second regulator 301 of the second hydraulic pump 3 to thereby increase the displacement volume of the second hydraulic pump 3. Simultaneously, the control valve 13 for swing moves to left in the figure, thus cuts off a circuit from the second hydraulic pump 3 to the tank T. The hydraulic fluid is sent to the swing motor 7 through a meter-in throttle of the control valve 13. At this point, the upper swing structure 101 is in a stationary state, and therefore places a heavy inertia load on the swing motor 7 so that the delivery pressure of the second hydraulic pump 3 rises sharply to reach the maximum pressure (relief pressure) of the hydraulic supply circuit determined by the relief valve 4. The controller 38 performs calculations shown in FIG. 4 using values of the swing operation pressure and the delivery pressure of the second hydraulic pump 3. Here, the delivery pressure of the second hydraulic pump 3 and the swing operation pressure are both at the maximum. The pump torque calculating section associated with pump delivery pressure 43, the pump torque calculating section associated with swing operation pressure 44, and the maximum value selecting section 45 shown in FIG. 4 perform calculations in such a manner as to reduce the maximum absorption torque of the second hydraulic pump 3 to Tc. Therefore, the control pressure output from the second solenoid proportional valve 32 is controlled so as to reduce the maximum absorption torque of the second hydraulic pump 3, and the displacement volume of the second hydraulic pump 3 is reduced. As a result, the delivery flow rate of the second hydraulic pump 3 decreases and thus the relief flow rate from the relief valve 4 decreases, to thereby reduce an energy loss during the swing start.

Thereafter, as the upper swing structure 101 accelerates to increase the swing speed, the relief from the relief valve 4 stops and the supply of a required flow rate from the second hydraulic pump 3 to the swing motor 7 becomes short, resulting in a decrease in delivery pressure of the second hydraulic pump 3. The controller 38 performs the calculations shown in FIG. 4 using values of the swing operation pressure and the delivery pressure of the second hydraulic pump 3. Here, the swing operation pressure is at the maximum, while the delivery pressure of the second hydraulic pump 3 is below the maximum pressure (relief pressure) of the hydraulic supply circuit determined by the relief valve 4. The pump torque calculating section associated with pump delivery pressure 43, the pump torque calculating section associated with swing operation pressure 44, and the maximum value selecting section 45 shown in FIG. 4 performs calculations in such a manner as to increase the maximum absorption torque of the second hydraulic pump 3 from Tc to Tb. The control pressure output from the second solenoid proportional valve 32 is controlled so as to increase the absorption torque of the second hydraulic pump 3 in accordance with the decrease of the delivery pressure of the second hydraulic pump 3 (control to vary the maximum absorption torque of the second hydraulic pump 3 according to the delivery pressure of the second hydraulic pump 3). The displacement volume of the second hydraulic pump 3 thus gradually increases. As a result, the delivery flow rate of the second hydraulic pump 3 increases with a rise in swing speed to thereby allow a required flow rate to be supplied to the swing motor 7, and a smooth shift to a constant speed swing can be achieved.

<Combined Operation of Swing and Boom Raising>

Operation during the combined operation of swing and boom raising will be described below.

When the control lever of the operation lever unit 18 for swing and the control lever of the operation lever unit 17 for boom are fully operated to the left in FIG. 1, the swing operation pressure acts on the flow rate control spool 312*a* of the second regulator 301 of the second hydraulic pump 3 and a boom operation pressure acts on the flow rate control spool 212*a* of the first regulator 201 of the first hydraulic pump 2. The displacement volumes of the first and second hydraulic pumps 2, 3 thereby increase. Simultaneously, the control valve 13 for swing and the control valve 12 for boom move to the left in the figure, thus cuts off circuits from the first and second hydraulic pumps 2, 3 to the tank T and the hydraulic fluid is sent to the boom cylinder 6 and the swing motor 7 through respective meter-in throttles of the control valves 12, 13. At this point, the upper swing structure 101 is in a stationary state and thus places a heavy inertia load on the swing motor 7, so that the delivery pressure of the second hydraulic pump 3 rises sharply to reach the maximum pressure (relief pressure) of the hydraulic supply circuit determined by the relief valve 4. The controller 38 performs calculations shown in FIG. 4 using values of the swing operation pressure and the delivery pressure of the second hydraulic pump 3. Here, the delivery pressure of the second hydraulic pump 3 and the swing operation pressure are both at the maximum. The pump torque calculating section associated pump delivery pressure 43, the pump torque calculating section associated with swing operation pressure 44, and the maximum value selecting section 45 shown in FIG. 4 perform calculations in such a manner as to reduce the maximum absorption torque of the second hydraulic pump 3 to Tc. Thus, the control pressure output from the second solenoid proportional valve 32 is controlled so as to reduce the maximum absorption torque of the second hydraulic pump 3, so that the displacement volume of the second hydraulic pump 3 is reduced. At the same time, the controller 38 performs a calculation in its subtraction section 47 to subtract the maximum absorption torque Tp2 of the second hydraulic pump 3 from the total pump torque Tr0, which results in an amount of torque reduced in the maximum absorption torque of the second hydraulic pump 3 being added to the maximum absorption torque of the first hydraulic pump 2. The distribution of the maximum absorption torque between the first and second hydraulic pumps 2, 3 is thereby changed. Consequently, the control pressure output from the first solenoid proportional valve 31 is controlled so as to increase the maximum absorption torque of the first hydraulic pump 2, and the displacement volume of the first hydraulic pump 2 increases. As described above, performing control to distribute the reduction in torque of the second hydraulic pump 3 to the first hydraulic pump 2, which drives the boom cylinder 6, an actuator other than the swing motor 7 (control to distribute the reduction in torque as a result of the torque reducing control of the second hydraulic pump 3 associated with the swing motor 7 to the first hydraulic pump 2 associated with an actuator other than the swing motor 7), allows the delivery flow rate of the second hydraulic pump 3 to decrease and the relief flow rate from the relief valve 4 to decrease, thereby reducing an energy loss during the swing start, and the boom cylinder speed to increase, thereby improving combined work operability and work efficiency.

Thereafter, as the upper swing structure 101 accelerates to increase the swing speed, the relief from the relief valve 4 stops and supply of a required flow rate from the second hydraulic pump 3 to the swing motor 7 becomes short, resulting in a decrease of delivery pressure of the second hydraulic pump 3. The controller 38 performs calculations shown in FIG. 4 using values of the swing operation pressure and the delivery pressure of the second hydraulic pump 3. Here, the swing operation pressure is at the maximum, while the delivery pressure of the second hydraulic pump 3 is below the maximum pressure (relief pressure) of the hydraulic supply circuit determined by the relief valve 4. The pump torque calculating section associated with pump delivery pressure 43, the pump torque calculating section associated with swing operation pressure 44, and the maximum value selecting section 45 shown in FIG. 4 perform calculations in such a manner as to increase the maximum absorption torque of the second hydraulic pump 3 from Tc to Tb. The control pressure output from the second solenoid proportional valve 32 is controlled so as to increase the maximum absorption torque of the second hydraulic pump 3 (control to vary the maximum absorption torque of the second hydraulic pump 3 according to the delivery pressure of the second hydraulic pump 3). The displacement volume of the second hydraulic pump 3 is then controlled to increase. As a result, a required flow rate is supplied to the swing motor 7 as the swing speed increases, thus achieving a smooth shift to a constant speed swing.

<Combined Operation of Swing and Boom Lowering, and Swing and Arm>

In the above description, operation during the combined operation of swing and boom raising has been described. Similar operation is also performed in the combined operation of swing and boom lowering, and the combined operation of swing and arm.

<Independent Bucket Operation, or Combined Operation of Boom or Arm and Bucket>

Operation for driving the bucket cylinder 8, which is an actuator associated with the second hydraulic pump 3 and is other than the swing motor 7, will be described below.

When the control lever of the operation lever unit 19 for bucket is operated, for example, fully to the left in FIG. 1, a bucket operation pressure acts on the flow rate control spool 312*a* of the second regulator 301 of the second hydraulic pump 3, to thereby increase the displacement volume of the second hydraulic pump 3. Simultaneously, the control valve 14 for bucket moves to the right in the figure, thus cuts off a circuit from the second hydraulic pump 3 to the tank T. The hydraulic fluid is sent to the bucket cylinder 8 through a meter-in throttle of the control valve 14. At this point, the controller 38 performs calculations shown in FIG. 4 using values of the swing operation pressure and the delivery pressure of the second hydraulic pump 3. Here, the operation lever of the operation lever unit 18 for swing is not operated and thus the swing operation pressure is minimum (tank pressure). The pump torque calculating section associated with pump delivery pressure 43, the pump torque calculating section associated with swing operation pressure 44, and the maximum value selecting section 45 of FIG. 4 performs calculations in such a manner as to increase the maximum absorption torque of the second hydraulic pump 3 to Tb, regardless of the delivery pressure of the second hydraulic pump detected by the pressure detecting means. The control pressure output from the second solenoid proportional valve 32 is therefore controlled so as to increase the maximum absorption torque of the second hydraulic pump 3. As a result, the maximum absorption torque of the second hydraulic pump 3 is controlled to remain constant regardless of changes in the delivery pressure of the second hydraulic pump 3, and a change in the speed of the bucket cylinder 8 due to a change in the maximum absorption torque of the second hydraulic pump 3 can be prevented, and operability and workability can be avoided from being degraded.

<Change in Target Engine Speed Nr>

When the target engine speed Nr of the engine 1 indicated by the engine speed command operating unit 37 is near the rated maximum speed, the total pump torque Tr0, calculated by the total pump torque calculating section 41 of the controller 38, is the maximum value Ta. The allocated maximum pump torque Tp2max of the second hydraulic pump 3 calculated by the second pump allocating torque calculating section 42 is the maximum value Tb (Tb=Ta/2). Therefore, in the minimum value selecting section 46 of the controller 38, including the case that the absorption torque calculated by the pump torque calculating section associated with pump delivery pressure 43, the pump torque calculating section associated with swing operation pressure 44, and the maximum value selecting section 45 is the maximum value Tb, calculation is performed in such a manner as to select the value directly. In the above-described operation, the maximum value Tb set in advance as the allocated maximum pump torque Tp2max of the second hydraulic pump 3 can therefore be fully utilized.

When, for example, an operator intending to conduct work with small operation amount, operates the engine speed command operating unit 37 to decrease the target engine speed Nr of the engine 1, the total pump torque calculating section 41 of the controller 38 calculates a value smaller than the maximum value Ta as the total pump torque Tr0. The second pump allocating torque calculating section 42 also calculates a value smaller than the maximum value Tb (Tb=Ta/2) as the allocated maximum pump torque Tp2max of the second hydraulic pump 3. As a result, even if the absorption torque, calculated by the pump torque calculating section associated with pump delivery pressure 43, the pump torque calculating section associated with swing operation pressure 44, and the maximum value selecting section 45, is the maximum value Tb, the minimum value selecting section 46 selects the value calculated by the second pump allocating torque calculating section 42, which is smaller than the maximum value Tb. The maximum absorption torque of the second hydraulic pump 3 is thus controlled to be reduced. Similarly, the subtraction section 47 subtracts the maximum absorption torque Tp2 selected by the minimum value selecting section 46 from the value calculated by the total pump torque calculating section 41, smaller than the maximum value Ta, to thereby calculate the maximum absorption torque Tp1 for control of the first hydraulic pump 2. The maximum absorption torque Tp1 for control of the first hydraulic pump 2 therefore becomes a small value, according to the value calculated by the total pump torque calculating section 41, and the maximum absorption torque of the first hydraulic pump 2 is controlled to be reduced. Consequently, the delivery flow rate of the first and second hydraulic pumps 2, 3 can be limited, thus capable of achieving work with small operation amount smoothly.

<Effects>

As described heretofore, in the embodiment of the present invention, control such that changes the maximum absorption torque of the second hydraulic pump 3 between Tb and Tc in accordance with the delivery pressure of the second hydraulic pump 3 during the independent swing operation. Consequently, an energy loss by relief during the swing start can be reduced to thereby improve energy efficiency, and during acceleration following the swing start, a required flow rate can be supplied to the swing motor 7, thus achieving a smooth shift to a constant speed swing and improving work efficiency.

In the combined swing operation combining swing with other motion, control such that distributes the amount of torque reduced in the torque of the second hydraulic pump 3 to the first hydraulic pump 2 associated with an actuator other than the swing motor 7 is performed. The speed of the actuator other than the swing motor 7 can be increased to thereby improve combined work operability and work efficiency.

In addition, only when the operation lever of the operation lever unit 18 for swing is operated, control such that varies the maximum absorption torque of the second hydraulic pump 3 in accordance with the delivery pressure of the second hydraulic pump 3 and distributes the amount of torque reduced in the second hydraulic pump 3 to the first hydraulic pump 2, associated with the actuator other than the swing motor 7, is performed. Consequently, during operation for driving the actuator other than the swing motor 7, a change in the speed of the actuator due to a change in the maximum absorption torque of the second hydraulic pump 3 can be prevented, and operability and workability can thereby be avoided from being degraded.

Further, when the target engine speed Nr of the engine 1 is decreased, control is performed to reduce the maximum absorption torque of the first and second hydraulic pumps 2, 3. The delivery flow rate of the first and second hydraulic pumps 2, 3 is thereby limited to achieve work with small operation amount smoothly.

In the above embodiment, hydraulic system including the two pumps of the first and second hydraulic pumps 2, 3 as main pumps has been described. However, the hydraulic system may include a third hydraulic pump other than the first and second hydraulic pumps 2, 3. Further, although each of the first and second hydraulic pumps 2, 3 has been described to constitute a single hydraulic pump, at least one of the two hydraulic pumps may be two hydraulic pumps controlled by total horsepower control. As mentioned, even if the number of hydraulic pumps differs, the same effects as those achieved by the above described embodiment can be achieved.

In the above embodiment, the controller 38 includes the maximum value selecting section 45 that selects the maximum value of an output from the pump torque calculating section associated with pump delivery pressure 43 and an output from the pump torque calculating section associated with swing operation pressure 44. The pump torque calculating section associated with swing operation pressure 44 and the maximum value selecting section 45 are included, in order to perform control such that varies the maximum absorption torque of the second hydraulic pump 3 in accordance with the delivery pressure of the second hydraulic pump 3, only when the operation lever of the operation lever unit 18 for swing is operated. Thus, the controller 38 may be such that includes, instead of the pump torque calculating section associated with swing operation pressure 44, a calculating section that outputs an ON signal when the swing operation pressure is equal to, or more than a predetermined value and includes, instead of the maximum value selecting section 45, a switch section that switches its position according to the ON signal, and the pump torque calculating section associated with swing operation pressure 44 and the minimum value selecting section 46 is connected via the switch section.

DESCRIPTION OF REFERENCE NUMERALS

1: engine
2: first hydraulic pump
3: second hydraulic pump
4: relief valve
5: arm cylinder
6: boom cylinder
7: swing motor
8: bucket cylinder
11 to 14: control valve
15: pilot pump
16 to 19: operation lever unit
21, 22: center bypass line
23*a*, 23*b*, 23*c*: shuttle valve
24*a*, 24*b*, 24*c*: shuttle valve
31: first solenoid proportional valve
32: second solenoid proportional valve
35: pressure sensor
36: pressure sensor
37: engine speed command operating unit
38: controller
41: total pump torque calculating section
42: second pump allocating torque calculating section
43: pump torque calculating section associated with pump delivery pressure
44: pump torque calculating section associated with swing operation pressure
45: maximum value selecting section
46: minimum value selecting section
47: subtraction section
48: first torque control pressure calculating section
49: second torque control pressure calculating section
100: lower track structure
101: upper swing structure
102: front work implement
103*a*, 103*b*: crawler type traveling mechanism
104*a*, 104*b*: left/right traveling motor
106: engine compartment
107: cabin
111: boom
112: arm
113: bucket
201: first regulator
211: tilting control actuator
211*a*: control piston
211*b*, 211*c*: pressure-receiving chamber
212: pump flow rate control valve
212*a*: flow rate control spool
212*b*: spring
212*c*: pressure-receiving chamber
213: pump torque control valve
213*a*: torque control spool
213*b*: spring
213*c*: PQ control pressure-receiving chamber
213*d*: torque reducing control pressure-receiving chamber
215 to 219, 221, 222: hydraulic line
301: second regulator
311: tilting control actuator
311*a*: control piston
311*b*, 311*c*: pressure-receiving chamber
312: pump flow rate control valve
312*a*: flow rate control spool
312*b*: spring
312*c*: pressure-receiving chamber
313: pump torque control valve
313*a*: torque control spool

313*b*: spring
313*c*: PQ control pressure-receiving chamber
313*d*: torque reducing control pressure-receiving chamber
315 to 317, 319, 321, 322: hydraulic line

The invention claimed is:

1. A pump control unit for a hydraulic system of a hydraulic excavator, the hydraulic system comprising:

first and second hydraulic pumps driven by a prime mover, the first and second hydraulic pumps being variable displacement type;

a plurality of first actuators driven by a hydraulic fluid delivered from the first hydraulic pump, the first actuators including a boom cylinder for driving a boom of the hydraulic excavator;

a plurality of second actuators driven by a hydraulic fluid delivered from the second hydraulic pump, the second actuators including a swing motor for driving an upper swing structure of the hydraulic excavator;

a plurality of operating means including first and second operating means for operating the boom cylinder and the swing motor, respectively; and a relief valve for determining respective maximum pressures of the hydraulic fluids delivered from the first and second hydraulic pumps;

the pump control unit comprising:

a pressure detecting means for detecting a delivery pressure of the second hydraulic pump;

a first pump torque control means for setting maximum absorption torque of the first hydraulic pump and controlling a displacement volume of the first hydraulic pump so that an absorption torque of the first hydraulic pump does not exceed the maximum absorption torque; and a second pump torque control means for setting maximum absorption torque of the second hydraulic pump and controlling a displacement volume of the second hydraulic pump so that an absorption torque of the second hydraulic pump does not exceed the maximum absorption torque, wherein the second pump torque control means has a preset maximum torque value consumable by the second hydraulic pump and a preset torque value less than the value of the maximum torque, and the second pump torque control means sets the maximum torque value as the maximum absorption torque of the second hydraulic pump when the delivery pressure of the second hydraulic pump detected by the pressure detecting means is lower than a predetermined pressure that is below the maximum pressure determined by the relief valve, and sets the torque value less than the maximum torque value as the maximum absorption torque of the second hydraulic pump when the delivery pressure of the second hydraulic pump detected by the pressure detecting means increases to reach the maximum pressure determined by the relief valve, and wherein the first pump torque control means sets, as the maximum absorption torque of the first hydraulic pump, the difference of the total pump torque consumable by the first and second hydraulic PUMPS and the maximum absorption torque of the second hydraulic pump set for the second pump torque control means.

2. The pump control unit for a hydraulic system according to claim 1, further comprising:

an operation amount detecting means for detecting an operation amount of the second operating means for operating the swing motor, wherein the second pump torque control means sets the torque value leses than the maximum torque value as the maximum absorption torque of the second hydraulic pump when the operation amount of the second operating means detected by the operation amount detecting means exceeds a predetermined value and the delivery pressure of the second hydraulic pump detected by the pressure detecting means increases to the maximum pressure determined by the relief valve, and sets the maximum torque value as the maximum absorption torque of the second hydraulic pump when the operation amount of the second operating means detected by the operation amount detecting means is equal to, or less than the predetermined value, regardless of the delivery pressure of the second hydraulic pump detected by the pressure detecting means.

* * * * *